US010998112B2

(12) United States Patent
Wagner et al.

(10) Patent No.: US 10,998,112 B2
(45) Date of Patent: May 4, 2021

(54) CARBON NANOTUBE BASED CABLING

(71) Applicant: Minnesota Wire, Inc., St. Paul, MN (US)

(72) Inventors: Paul J. Wagner, Eagan, MN (US); Thomas Kukowski, Apple Valley, MN (US); Mike Matuszewski, St. Paul, MN (US)

( * ) Notice: Subject to any disclaimer, the term of this patent is extended or adjusted under 35 U.S.C. 154(b) by 0 days.

(21) Appl. No.: 16/510,892

(22) Filed: Jul. 13, 2019

(65) Prior Publication Data

US 2019/0341170 A1 Nov. 7, 2019

Related U.S. Application Data

(63) Continuation-in-part of application No. 15/968,375, filed on May 1, 2018.

(51) Int. Cl.

| | |
|---|---|
| ***H01B 11/00*** | (2006.01) |
| ***H01B 11/10*** | (2006.01) |
| ***H01B 11/18*** | (2006.01) |
| ***H01B 7/00*** | (2006.01) |
| ***H01B 1/04*** | (2006.01) |

(52) U.S. Cl.

CPC ..... *H01B 11/1033* (2013.01); *H01B 1/04* (2013.01); *H01B 7/0009* (2013.01); *H01B 11/1813* (2013.01)

(58) Field of Classification Search

CPC ... H01B 1/02; H01B 1/04; H01B 7/04; H01B 7/009; H01B 11/1033; H01B 11/1813; H01B 11/1834; H01B 13/0162

USPC ..... 174/102 R, 103, 106 R, 108, 109

See application file for complete search history.

(56) References Cited

U.S. PATENT DOCUMENTS

| | | | | |
|---|---|---|---|---|
| 9,111,658 | B2 * | 8/2015 | Shah | H01B 1/24 |
| 9,193,586 | B2 * | 11/2015 | Wei | B82Y 30/00 |
| 2007/0151744 | A1 * | 7/2007 | Chen | H01B 1/026 174/110 R |
| 2007/0293086 | A1 * | 12/2007 | Liu | H01B 11/1808 439/578 |
| 2008/0170982 | A1 * | 7/2008 | Zhang | B82Y 10/00 423/447.3 |
| 2009/0255706 | A1 * | 10/2009 | Jiang | H01B 1/24 174/102 R |
| 2011/0005808 | A1 * | 1/2011 | White | H01B 1/026 174/126.2 |
| 2012/0125656 | A1 * | 5/2012 | Wei | B82Y 30/00 174/103 |
| 2012/0171485 | A1 * | 7/2012 | Lee | D06M 11/83 428/373 |
| 2012/0247800 | A1 * | 10/2012 | Shah | H01B 1/24 174/36 |
| 2014/0102755 | A1 * | 4/2014 | Adriaenssens | H01B 11/1895 174/113 R |
| 2017/0236621 | A1 | 8/2017 | Silverman et al. | |

* cited by examiner

*Primary Examiner* — William H. Mayo, III
(74) *Attorney, Agent, or Firm* — FisherBroyles, LLLP; Gregory T. Fettig

(57) ABSTRACT

One cable shielding has a first metal shielding braided along a length of a cable, a CNT paper shielding surrounding the first metal shielding along the length of the cable, and a second metal shielding braided about the CNT paper shielding along the length of the cable.

10 Claims, 7 Drawing Sheets

CARBON NANOTUBE BASED CABLING

CROSS REFERENCE TO RELATED APPLICATIONS

This patent application is a continuation-in-part patent application claiming priority to, and thus the benefit of an earlier filing date from, U.S. patent application Ser. No. 15/968,375 (filed May 1, 2018), which claims priority to, and thus the benefit of an earlier filing date from, U.S. Provisional Patent Application No. 62/492,878 (filed May 1, 2017), the contents of each of which are hereby incorporated by reference.

BACKGROUND

Cabling is ubiquitous. For example, power cables, coaxial cables, and electrical cables, and the like can be found in a variety of industries, such as the building industry, the aerospace industry, the telecommunications industry, and the automotive industry. These cables are configured with some form of metal, such as copper, in an application dependent configuration. For example, a coaxial cable may have a copper core surrounded by a dielectric, which is then shielded typically with a braided metal or foil. Twisted pair conductors, on the other hand, have solid metal cores (e.g., copper) surrounded by insulators.

These metal cores, while necessary for their respective applications, add significantly to the weight of the cable. And, weight savings is an important issue in many industries. For example, aircraft contain many wires and cables that significantly increase the overall weight of the aircraft. This weight increase requires the aircraft to use more fuel. But, the cables are necessary as they serve a variety of purposes, including the support of communication and navigation electronics. Reducing the weight of the wire and cabling of the aircraft can reduce the amount fuel necessary to fly the aircraft, thereby reducing costs. However, cable reliability is still critical in aircraft as cable failure can be catastrophic.

SUMMARY

In one embodiment, a cable includes a conductive core configured from or more strands of metalized carbon nanotubes (e.g., "CNTs" electroplated with copper, silver, nickel, aluminum, tin, gold, combinations thereof, or the like), a shielding surrounding the core(s) along the length of the cable, and a jacket surrounding the shielding(s) along the length of the cable. The cable may also include an insulative material (e.g., an insulator and/or a dielectric) surrounding the conductive core(s). In some embodiments a shielding surrounds the insulative material along the length of the cable, and an outer jacket may be configured along the length of the cable. The shielding may also be configured from metalized CNTs that have been braided, configured as a CNT paper, or a combination thereof. In another embodiment, a cable production method includes configuring a plurality of CNTs into a strand, and metalizing the strand of CNTs (e.g., electroplating the CNTs with copper, silver, nickel, aluminum, tin, gold, combinations thereof, or the like) to form a conductive core. The method may also include providing a shielding around the strand of metalized CNTs along the length of the cable, and surrounding the shielding with a jacket along the length of the cable.

DETAILED DESCRIPTION OF THE DRAWINGS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention and are to be construed as being without limitation to such specifically recited examples and conditions. As a result, the invention is not limited to the specific embodiments or examples described below.

Figure 1:
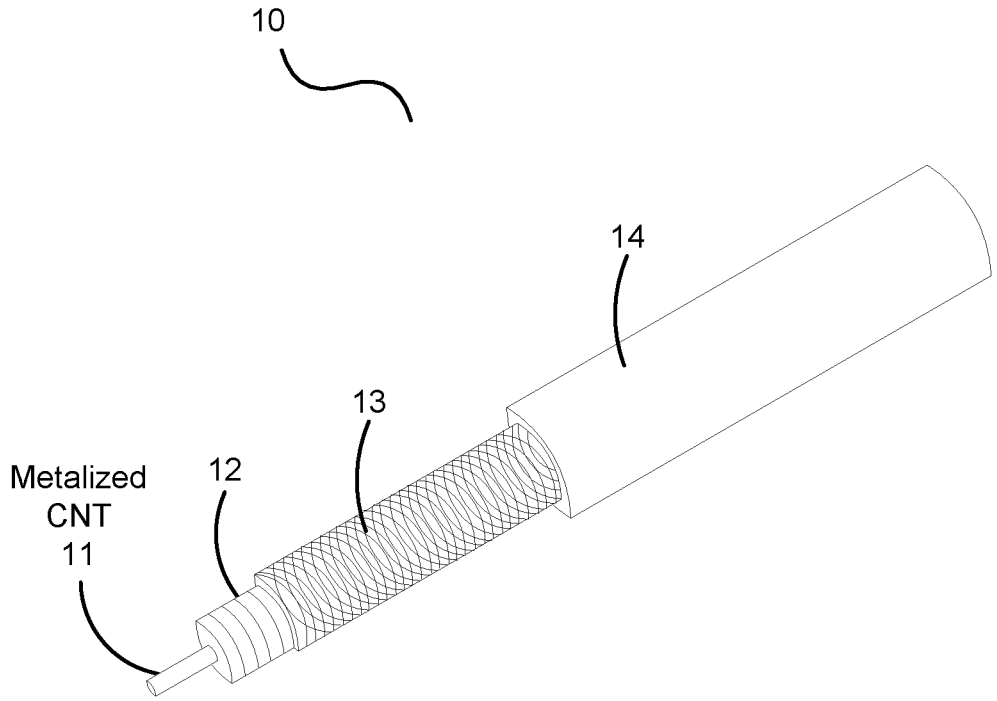
FIG. 1 is a perspective view of one exemplary cable.

FIG. 1 is a perspective view of an exemplary cable 10. In this embodiment, the cable is configured with a conductive core 11. The conductive core 11 includes a strand of CNTs that has been metalized (e.g., electroplated with copper, silver, nickel, aluminum, tin, gold, combinations thereof, or the like). The CNTs are generally grown in a chamber to produce a "yarn". For example, tungsten foil may be sputtered with iron as part of a "seeding" process to produce the CNTs. Then, the sputtered tungsten foil may be placed in a chamber through which acetylene gas passes. As the sputtered tungsten foil is heated, the CNTs tend to "grow" on the surface of the foil. Once collected, the CNTs have the material appearance of wool.

The CNT "wool" may be spun into a yarn or strand to form the core of the conductor. While the strand of CNTs is generally conductive, it still may not produce the results required in certain industries, such as the aerospace and satellite industries. For example, aircraft and satellites have incredibly stringent requirements in terms of signaling and conduction to prevent catastrophic failure. So, to improve the conductivity of the CNT strand, the CNT strand may be metalized (e.g., electroplated with copper, silver, nickel, aluminum, tin, gold, combinations thereof, or the like).

In traditional cabling, copper is used due to its high conductivity and plentiful nature. For example, silver is the most conductive metal on earth. However, silver is expensive due to its rarity. Copper has the second highest conductivity of metals on earth and is much more abundant than silver. So, copper is typically used in cabling where conductivity is necessary (e.g., signaling, power, etc.).

Of course, some objectives of the present embodiments are to reduce the weight associated with metals in cabling. To accomplish such, the embodiments herein present a CNT strand which is metalized to enhance the conductivity of the conductive core 11. This also provides the CNT strand with a desired level of rigidity. In some embodiments, the process involves placing the strand of CNTs in a bath of metal salt, such as copper sulfate or the like. The strand is connected to a voltage source and acts as the cathode. An anode in the bath transfers metal to the strand when a voltage is applied. One or more metals can be used in one or more electroplating processes. For example, silver can further enhance the conductivity through electroplating in a similar fashion albeit with a different electrolyte (e.g., AgNO3).

Once the conductive core 11 is configured, the conductive core may be configured with a dielectric and/or insulative material 12. The material 12 may be configured about the conductive core along a length of the cable 10 in a variety of ways as a matter of design choice and/or application. For example, when configuring the cable 10 as a conductor (e.g., as in a twisted pair configuration), the material 12 may be used as an insulator. When configuring the cable 10 as a coaxial cable, the material 12 may operate as a dielectric material with a certain level impedance.

The impedance of the 12 may be configured to be adjustable. For example, the material 12 may be an expanded Polytetrafluoroethylene (ePTFE) tape that is wrapped about the conductive core 11. The number of layers/wrappings of the tape about the conductive core 11 may determine the thickness of the material 12. Thus, by changing the thickness of the material 12 based on the number of layers/wrappings of the tape about the conductive core 11, the impedance of the material 12 can be adjusted as a matter of design choice (e.g., pre-determined).

Alternatively or additionally, the conductive core 11 may be embedded in a dielectric material. For example, the conductive core 11 may be embedded in plastic which is subsequently hardened. Then, the conductive core 11 and the material 12 can be extruded to form a sturdier cable.

In whatever configuration, once the material 12 is configured with the conductive core 11, the cable 10 may be shielded with a suitable shielding material 13. For example, the material 12 may be surrounded with a metallic braiding (e.g., copper, aluminum, silver etc.). Alternatively or additionally, the material 12 may be surrounded with a metallic foil. In one embodiment, the shielding 13 may be configured in a manner such as the conductive core 11 itself. For example, the shielding may be configured from strands of CNTs that are metalized (e.g., electroplated with copper, silver, nickel, aluminum, tin, gold, combinations thereof, or the like) which can then be braided about the material 12 along the length of the cable 10. In yet another embodiment, the shielding may be configured as a CNT paper.

Once the shielding is installed, the cable 10 may be protected with an outer protective jacket 14. Any of several materials may be used to provide the protective jacket 14, such as shrink-wrap plastics and tapes, rubber, etc. The cable 10 may then be used in any variety of cabling configuration including a coaxial cable configuration, a twisted pair configuration, an ethernet configuration, a category 5 cable configuration, and/or a category 6 cable configuration.

In one embodiment, a strand of CNTs may be metalized with copper and silver. But, the embodiments herein are not intended to be limited to any type of metal used or any order of metallization. Some embodiments herein use copper and silver due to its conductivity performance.

In another embodiment, a CNT strand may be metalized through a microfabrication of thin-film processes to achieve a relatively high quality precision surface that provides relatively low insertion loss and relatively high frequency performance. Chemical vapor deposition (CVD) is one example of a process that may be used to produce a metalized plated conductive layer. For example, a CNT strand may be placed in a vacuum to provide a vapor-phase chemical reaction in a relatively high temperature gas enclosed chamber. Another process may include physical vapor deposition (PVD) whereby a relatively pure source material is gasified via evaporation utilizing laser ablation. The gasified material may then controllably condense on the CNT substrate to create a desired conductive layer. Metals that may be used in these processes include copper, silver, nickel, aluminum, tin, and gold.

The applied metals are typically much more conductive than CNT. This allows a highly efficient conductivity to reduce resistance of high frequency energy. A thin plating enhances the "skin effect" performance (explained below) with little added weight penalty to the base CNT. And, the thickness of the conductive plating is a function of the frequency of the application for data and/or coaxial cables. These conductivity enhanced CNT strands can be used as conductors, braided shielding, and/or wrapped shielding.

The conductivity enhancement of these CNT strands may address a "skin depth" phenomenon of high frequency current flow in conductors including round conductors, strand conductors, conductive tape, etc.). To illustrate, the cross-sectional area of a conductor may dictate its direct current (DC) resistance. Thus, the larger the conductor is, the lower its resistance is. And, direct current (DC) may be uniform throughout the cross section of the conductor. However, alternating current (AC) at high frequencies generally does not penetrate radially inward in a conductor due to induced eddy currents. Thus, the current tends to flow in an outer layer at the surface of the conductor with less current flowing thru the center of the conductor. The higher that the frequency of the current is, the smaller that the depth of the conductor is to which the current penetrates. This may crowd the current into an increasingly smaller cross-sectional area at the surface. Thus, the AC resistance of wire may increase with frequency.

This phenomenon is referred to the skin effect and the depth of the current penetration is referred to as the skin depth. Skin depth is generally the region of interest addressed with copper and/or silver plating. Skin depth may be defined as the required surface thickness of a metal at any frequency for which roughly 63.2% of the current is flowing. For example, in a 100 MHz cable the conductive skin depth of copper is about 7 microns, and in a 1 GHz cable the skin depth of copper is about 2 microns. A cable designed with a 100 MHz skin depth is inherently compliant with higher frequencies of operation. Achieving 99% of the current flow on a conductor surface may require about 4.6 skin depths for a given frequency, allowing longer cable runs to be compliant with any given application.

In theory, this generally applies to round conductors (e.g., metalized CNT strands or wires) and planar CNT conductors (e.g., shielding tapes). Given that much of the center conductive material is not utilized, a lightweight conductive CNT is an efficient substrate for skin depth enhanced cables. These cables commonly operate from 1 MHz to 8 GHz in coaxial cable and twisted pair cable assemblies.

It should be noted that the embodiments herein are only intended to provide the reader with an understanding of the inventive concepts herein. Additionally, it should be noted that the cable 10 is not intended to be limited to any particular length and/or cross-sectional size/shape as such features are a matter of design choice.

Figure 2:
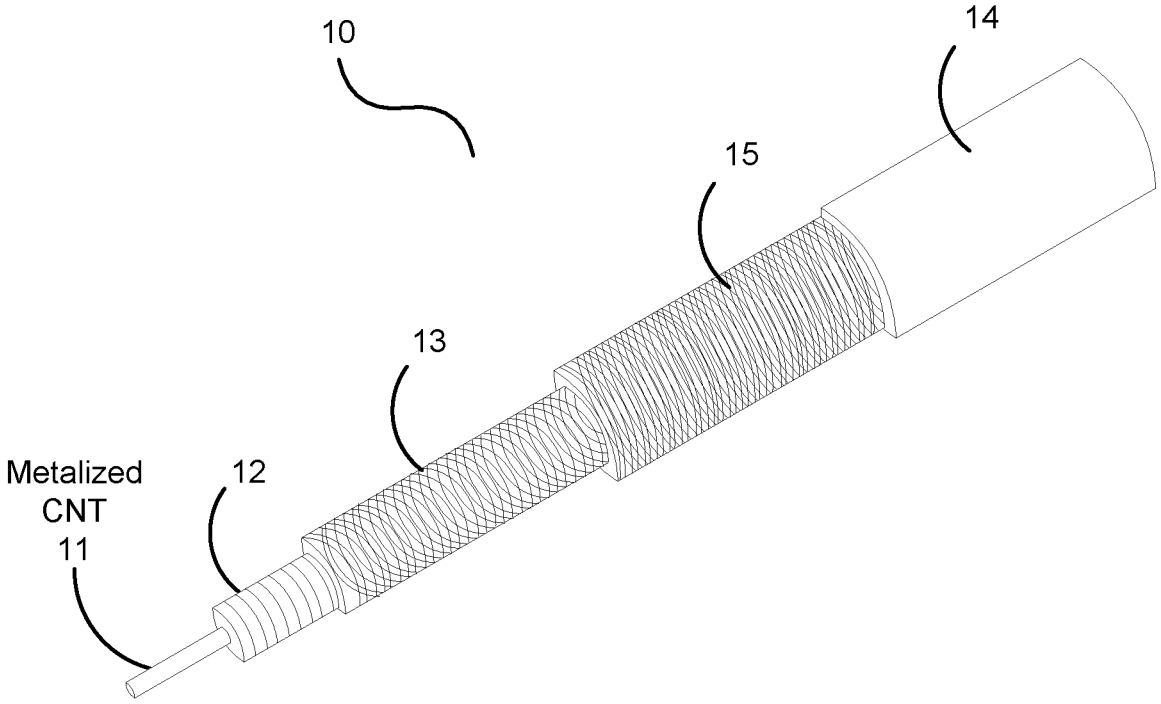
FIG. 2 is a perspective view of another exemplary cable.

FIG. 2 is a perspective view of another exemplary cable 10. In this embodiment, the cable 10 is similarly configured to the cable 10 in FIG. 1. In this embodiment, however, the cable 10 is also configured with another shielding 15 between the protective jacket 14 and the shielding 13. Like the shielding 13, the shielding 15 may be configured in a variety of ways as a matter of design choice, including metalized CNT strands, braided metal, foil, or the like. In this embodiment, the cable 10 is operable as a coaxial cable (e.g., once it is configured with a coaxial cable termination).

And, as a coaxial cable, the cable 10 is operable to pass frequencies from about 100 MHz to beyond 16 GHz, depending on the configuration.

Figure 3:
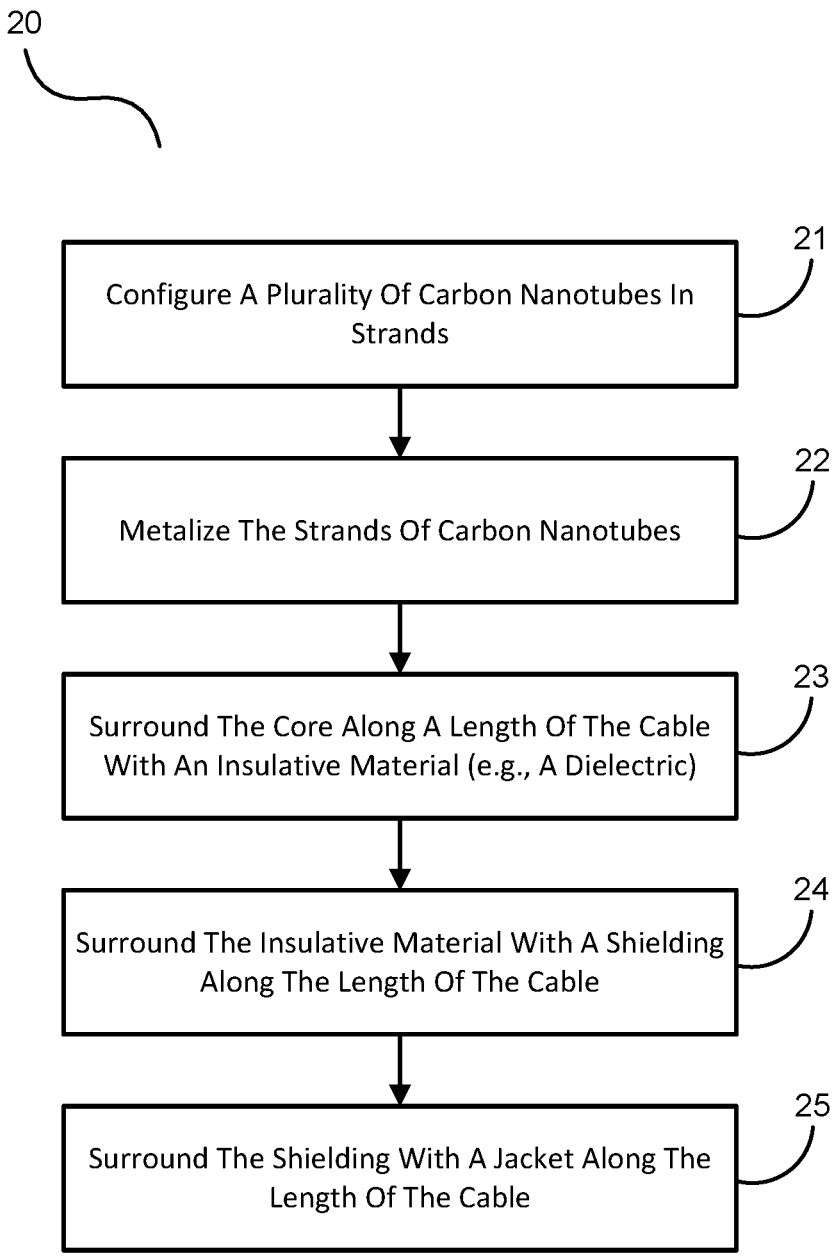
FIG. 3 is a flowchart of an exemplary process for making a cable.

FIG. 3 is a flowchart of an exemplary process 20 for making the cable 10. In this embodiment, the process 20 begins after a CNT wool has been grown and collected. Then, the CNT wool is spun into strands, in the process element 21. Thereafter, the strands of CNTs are metalized (e.g., electroplated with copper, silver, nickel, aluminum, tin, gold, combinations thereof, or the like), in the process element 22. For example, a strand of CNTs may be configured as a cathode that is placed in a bath of a metal solution. Then, when a voltage is applied, the corresponding metal electrolyte(s) metalize to the strand of CNTs. Once the electroplating is complete, the CNTs form the conductive core 11 of the cable 10.

With the conductive core 11 configured, it may then be wrapped along the length of the cable with an insulative/dielectric material 12 (e.g., ePTFE tape) about the conductive core 11, in the process element 23. Again, the impedance of the material 12 may be determined by the number of times that the material 12 is wrapped and/or layered about the conductive core 11. Once the material 12 is configured with the conductive core 11, the cable 10 may be braided with a shielding 13 around the material 12 along the length of the cable 10, in the process element 24. Then, the cable 10 may be surrounded with a protective jacket outside of the shielding 13 along the length of the cable, in the process element 25.

Figure 4:
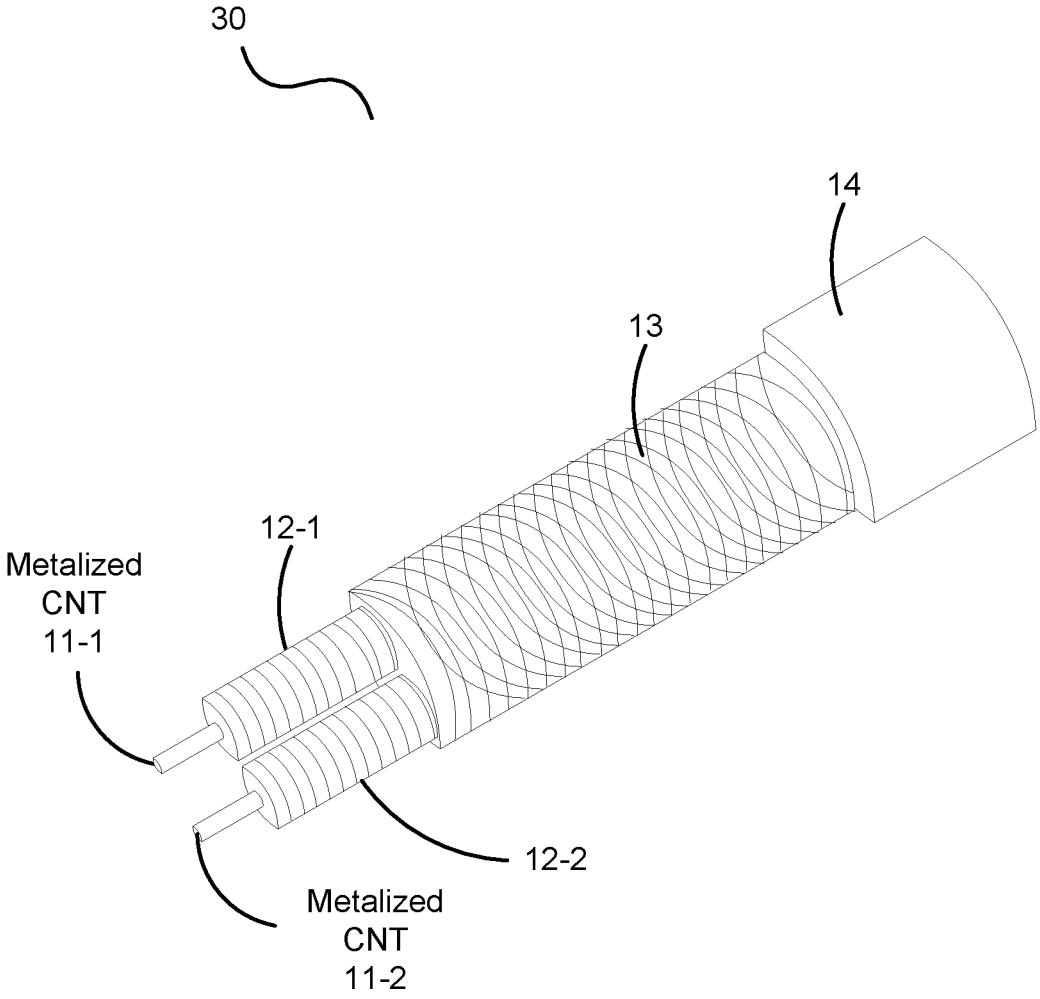
FIG. 4 is a perspective view of an exemplary twisted pair cable.

FIG. 4 is a perspective view of an exemplary twisted pair cable 30. In this embodiment, the twisted pair cable 30 includes many of the components in the above embodiments, albeit configured differently. For example, the cable 30 may include two CNT conductors 11-1 and 11-2 that have been metalized (e.g., electroplated with copper, silver, nickel, aluminum, tin, gold, combinations thereof, or the like). The conductors 11-1 and 11-2 may then each be surrounded with a material 12. In this embodiment, the insulators 12-1 and 12-2 are surrounded with an insulative material (e.g., which can also function as a dielectric depending on the application) wrapped about each of the conductive cores 11-1 and 11-2. Of course, the conductive cores 11-1 and 11-2 may be surrounded with an insulator in other ways as a matter of design choice (e.g., embedded in rubber or plastic and extruded). The insulated conductive cores may then be shielded with a shielding material 13 (e.g., braided metal, braided metalized CNTs conductors, metal foil, metalized CNT "paper", etc.). Once shielded, the cable 30 may be surrounded with an outer protective jacket 14 as described above.

Although shown and described as a single twisted pair cable configuration, those skilled in the art will readily recognize that the number of "twisted pairs" can be expanded. For example, in a category 5 cable configuration, the cable 30 may be configured with multiple twisted pairs. Thus, in a category 5 cable configuration with four twisted pairs, the cable 30 would have eight conductive cores 11 configured from metalized CNT strands (e.g., using silver and/or copper). Each of those strands would be insulated and the entire cable 30 may then be surrounded with a shielding material, as described above. Accordingly, the embodiment is not intended to be limited to any number of twisted pairs.

Figure 5:
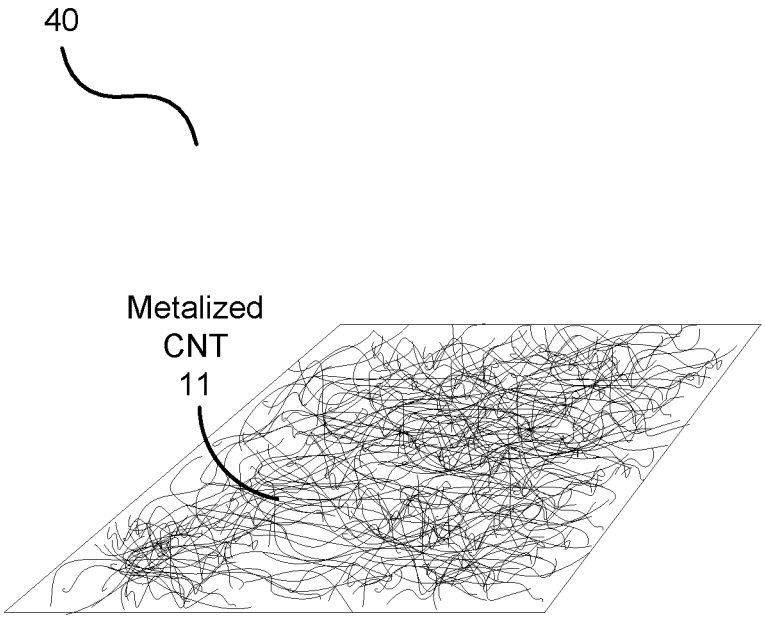
FIG. 5 is a perspective view of an exemplary metalized CNT paper.

FIG. 5 is a perspective view of an exemplary metalized CNT paper 40. For example, once the CNTs are grown and collected as a wool, the CNTs may be configured into strands that are then metalized (e.g., using silver and/or copper) as described above. Then, the metalized strands may be laid out in a sort of paper or even adhered to a tape that can be wrapped around an insulator to form a shielding. Alternatively, the strands may be flattened into a paper that is subsequently metalized. Still, the metalized strands may even be braided to form a shielding.

Whatever the configuration, the metalized CNTs advantageously provide a means for weight reduction in cabling. Again, traditional metal core cables add significant weight. The embodiments herein significantly reduce the cable weight, thereby reducing costs associated with weight in certain industries, such as the aircraft industry. Other examples of industries that could benefit from reduced cabling weight include satellite production. For example, the cost of developing and producing satellites is linearly proportional to the satellite's weight. Large satellites, which weigh more than 1,000 Kilograms (kg), cost about $250 million or more. Micro-satellites, which weigh between 10 and 100 kg, cost around $3 million. Mini-satellites, which weigh between 100 and 500 kg, cost around $14 million. In this regard, satellites often cost more than $200,000 per kilogram, reaching $1 million per kilogram with delivery-to-space costs included. For example, transportation costs to geosynchronous orbits using a National Aeronautic Space Agency (NASA) reusable launch vehicle vary from $10,000 per pound of payload to greater than $160,000 per pound. And, the scarcity of annual launches forces organizations to make the most of each launch by maximizing the satellite capability, size, and/or weight to the target class of launch vehicle.

In an effort to minimize launch costs, a smaller satellite paradigm (e.g., CubeSats) proposes to reduce size, weight, and power consumption of satellites while not reducing payload capabilities. Significant weight reductions can enable the use of small launch vehicles, which can be on the order of 50 percent less than a medium launch vehicle.

Furthermore, each kilogram saved in the satellite bus or instruments represents a potential 5 kg savings in launch, onboard propulsion, and altitude-control systems mass. This reduced mass also has the capability to produce indirect cost savings via shorter transit times, mission duration, and the elimination of large facilities and costly equipment, such as high bays, clean-room areas, test facilities and special handling equipment and containers.

It has been a challenge to effectively shield sensitive electronic equipment from electromagnetic interference (EMI) without adding significant weight of satellites. The more massive a satellite is, the more fuel it needs to achieve orbit. EMI shielding for wire and cables is an attractive opportunity for weight reduction. For example, copper wiring makes up as much as one-third of the weight of a 15-ton satellite. Half of this wire weight is typically in the EMI shielding. However, it is important that weight reductions do not come at the expense of EMI shielding effectiveness. Wiring and connectors are particularly vulnerable to electromagnetic interference. By substituting products that offer comparable shielding effectiveness, satellites can achieve dramatic weight-savings with minimal risk to the applications it serves.

Systems and methods presented herein provide for weight savings associated with cables. In some embodiments, more than 20 pounds per 1,000 linear feet in weight savings is possible by replacing the traditional copper components with the metalized CNT components. For example, by incorporating the above embodiments in low voltage differential signaling (LVDS), the cabling has a signaling performance comparable to that of traditional Commercial Off-The-Shelf (COTS) LVDS cabling, but with a weight reduction of more than 40 percent. And, the cabling has a demonstrated signal integrity compliance between 1 Gbps and 3 Gbps for lengths of 3 to 30 feet.

In one embodiment, the strand of CNTs may be metalized first with copper so as to provide a base-layer under coat of the CNTs. This may assist in eliminating course roughness and providing concentricity with the conductor circular cross-sectional symmetry. Then, conductivity may be enhanced with a layer of silver which also maintains smoothness and concentric symmetry of the finished conductive core 11.

Figure 6:
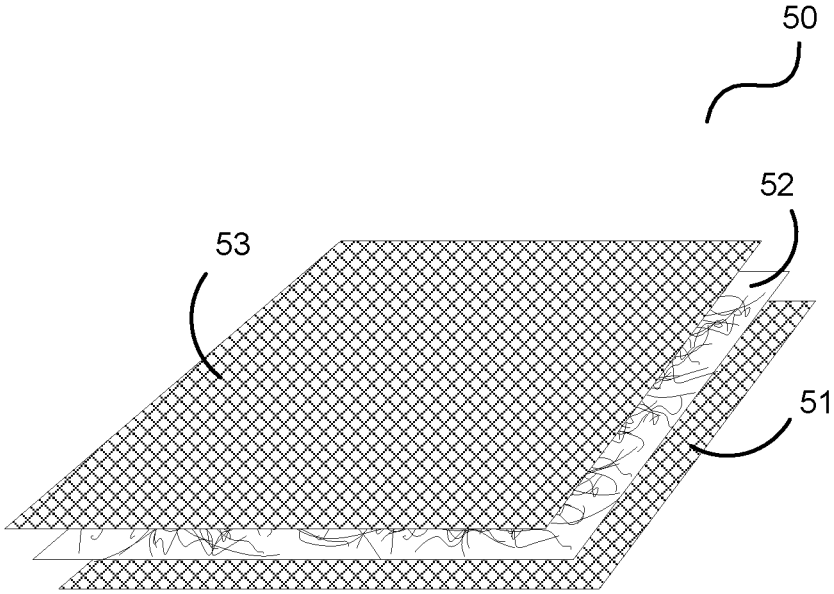
FIG. 6 is a perspective view of an exemplary shielding.

FIG. 6 is a perspective view of an exemplary shielding 50. In this embodiment, the shielding 50 includes three shielding layers 51, 52, and 53. The first shielding layer 51 includes braided metal, such copper or tinned copper. The second shielding layer 52 includes CNT wool flattened to form a sort of CNT paper. The third shielding layer 53 also includes a braided metal, such as copper or tinned copper. Thus, the second shielding layer 52 is sandwiched between braided metal layers 51 and 53. The second shielding layer 52 may improve shielding performance by decreasing decibel levels of external electromagnetic interference (EMI), thereby allowing for faster data transfers when implemented in a cable. However, the shielding 50 may be used in a variety of ways to provide EMI protection.

Figure 7:
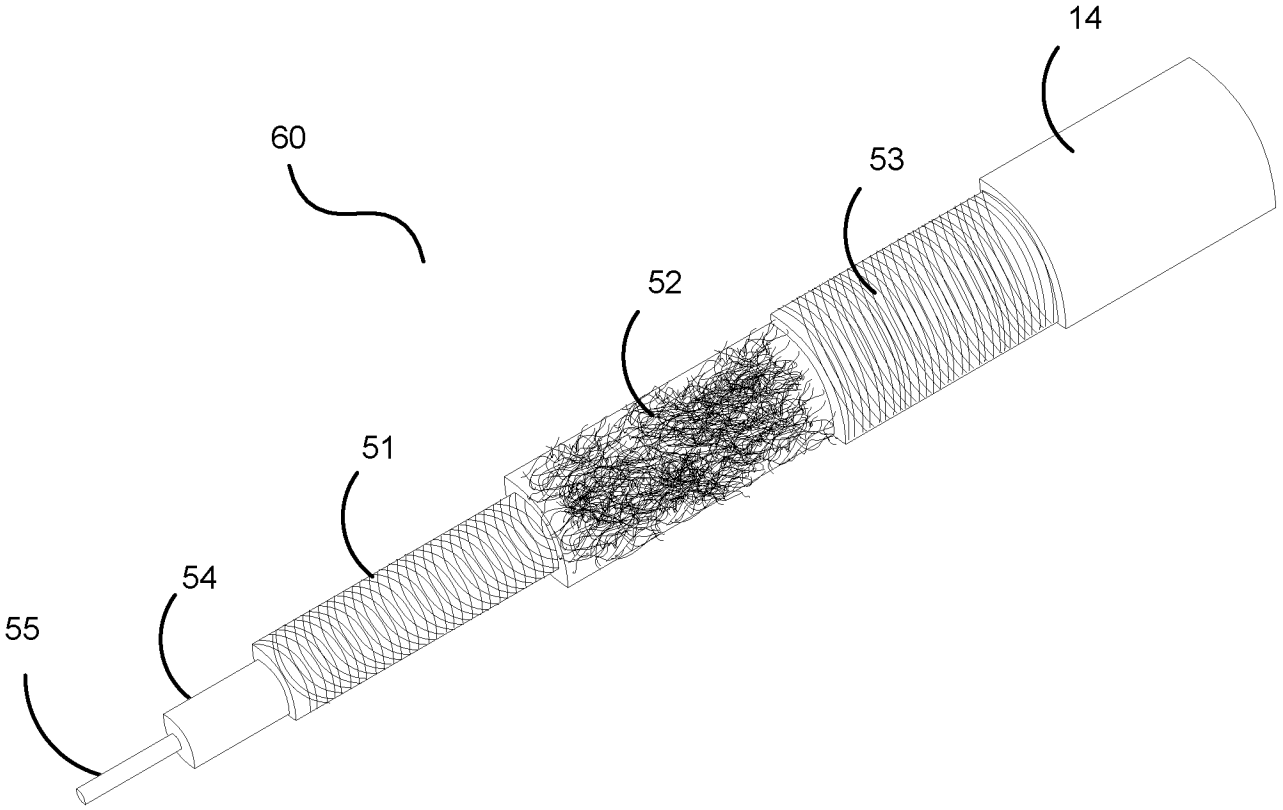
FIG. 7 is a perspective view of an exemplary cable incorporating the shielding of FIG. 6.

FIG. 7 is a perspective view of an exemplary cable 60 incorporating the shielding 50 of FIG. 6. In this embodiment, the cable 60 is configured as a coaxial cable. But, like the embodiments above, the shielding can be configured in a variety of cables, such as Universal Serial Bus (USB) cables, Electrical and Electronics Engineers (IEEE) 1394 cables, Lightning connection cables, and the like.

The cable 60, of this embodiment, includes a conductive core 55, an insulative material 54 (e.g., an insulator or a dielectric). The material 54 surrounds the conductive core 55 along a length of the cable 60. The braided metal shielding layer 51 surrounds the 54 along the length of the cable 60. The braided metal shielding layer 51 may be surrounded by the CNT shielding layer 52, which may be surrounded by another braided metal shielding layer 53, along the length of the cable 60. Thus, the CNT shielding layer 52 is sandwiched between the braided metal shielding layers 51 and 53 along the length of the cable 60. The cable 60 may also be configured with a protective jacket 14 as discussed above.

Those skilled in the art should readily recognize that the embodiments herein may be combined in a variety of ways as a matter of design choice. For example, the shielding 50 may be used in one or more of the cable designs described above where the cables have one or more conductive cores (e.g., conductive cores 11 and/or 55). Accordingly, the embodiments illustrated herein are not intended to be limiting in nature.

What is claimed is:

1. A cable shielding, comprising:
a first metal shielding braided along a length of a cable;
a CNT paper shielding surrounding the first metal shielding along the length of the cable; and
a second metal shielding braided about the CNT paper shielding along the length of the cable.

2. A low voltage differential signaling (LVDS) cable, comprising:
a first carbon nanotube (CNT) strand;
a first copper layer affixed directly to a surface of the first CNT strand;
a second carbon nanotube (CNT) strand;
a second copper layer affixed directly to a surface of the first CNT strand;
a first metal shielding braided about the first CNT strand, the first copper layer, the second CNT strand, and the second copper layer along a length of the cable;
a CNT paper shielding surrounding the first metal shielding along the length of the cable; and
a second metal shielding braided about the CNT paper shielding along the length of the cable.

3. The cable of claim 1, wherein:
the first metal shielding comprises copper or tinned copper.

4. The cable of claim 1, wherein:
the second metal shielding comprises copper or tinned copper.

5. The cable of claim 1, further comprising:
a jacket surrounding the second metal shielding along a length of the cable.

6. The LVDS cable of claim 1, wherein:
the first CNT strand comprises another metal that is electroplated to the first CNT strand.

7. The LVDS cable of claim 1, wherein:
the first CNT strand comprises another metal that is physical vapor deposited to the first CNT strand.

8. The LVDS cable of claim 1, wherein:
the first CNT strand comprises another metal that is chemical vapor deposited to the first CNT strand.

9. The LVDS cable of claim 1, wherein:
the first copper layer is electroplated to the first CNT strand.

10. A coaxial cable, comprising:
a conductor;
an dielectric surrounding the conductor along a length of the cable;
a first metal shielding braided about the dielectric along the length of the cable;
a CNT paper shielding surrounding the first metal shielding along the length of the cable; and
a second metal shielding braided about the CNT paper shielding along the length of the cable.

* * * * *